US010337326B2

(12) United States Patent
Thomson

(10) Patent No.: US 10,337,326 B2
(45) Date of Patent: Jul. 2, 2019

(54) METHOD AND APPARATUS FOR FORMING TUNNELS FOR TRANSPORT ROUTES

(71) Applicant: James Crawford Thomson, Grilly (FR)

(72) Inventor: James Crawford Thomson, Grilly (FR)

( * ) Notice: Subject to any disclaimer, the term of this patent is extended or adjusted under 35 U.S.C. 154(b) by 0 days.

(21) Appl. No.: 15/538,143

(22) PCT Filed: Dec. 22, 2015

(86) PCT No.: PCT/GB2015/054108

§ 371 (c)(1),
(2) Date: Jun. 20, 2017

(87) PCT Pub. No.: WO2016/102946

PCT Pub. Date: Jun. 30, 2016

(65) Prior Publication Data

US 2017/0342834 A1 Nov. 30, 2017

(30) Foreign Application Priority Data

Dec. 22, 2014 (GB) ..... 1422937.1

(51) Int. Cl.
*E21D 9/00* (2006.01)
*E01C 1/00* (2006.01)
*E02D 29/045* (2006.01)

(52) U.S. Cl.
CPC ..... *E21D 9/005* (2013.01); *E21D 9/03* (2016.01); *E01C 1/002* (2013.01); *E02D 29/045* (2013.01)

(58) Field of Classification Search
CPC ..... E21D 9/005; E21D 9/03; E01C 1/002; E02D 29/045
See application file for complete search history.

(56) References Cited

U.S. PATENT DOCUMENTS 6,640,505 B1 * 11/2003 Heierli ..... E02D 29/045 52/169.14
6,652,190 B1 * 11/2003 Verkyk ..... E21B 7/205 175/62
6,668,729 B1 * 12/2003 Richards ..... B61B 15/00 104/124
2007/0261341 A1 * 11/2007 Lockwood ..... E02D 29/045 52/380
2011/0113705 A1 * 5/2011 Raczkowski ..... E01C 1/002 52/173.3

(Continued)

FOREIGN PATENT DOCUMENTS

WO 2014114941 A2 7/2014

*Primary Examiner* — Benjamin F Fiorello
(74) *Attorney, Agent, or Firm* — McKee, Voorhees & Sease, PLC

(57) ABSTRACT

A method and apparatus for forming a tunnel structure at a relatively shallow depth from the surface, which tunnel can be used as a replacement or additional transport route to an existing transport route (2) which is already formed on the surface. The method comprises the steps of forming two spaced apart access tunnels (hatched portion) to expose the tracks, introducing units (22) comprising side walls portions (26, 28) and a roof section (30) by moving the units along the tracks while excavating the soil in which the tunnel is to be formed is in advance of the leading edge of the units.

14 Claims, 9 Drawing Sheets

(56) References Cited

U.S. PATENT DOCUMENTS

Figure 1A:
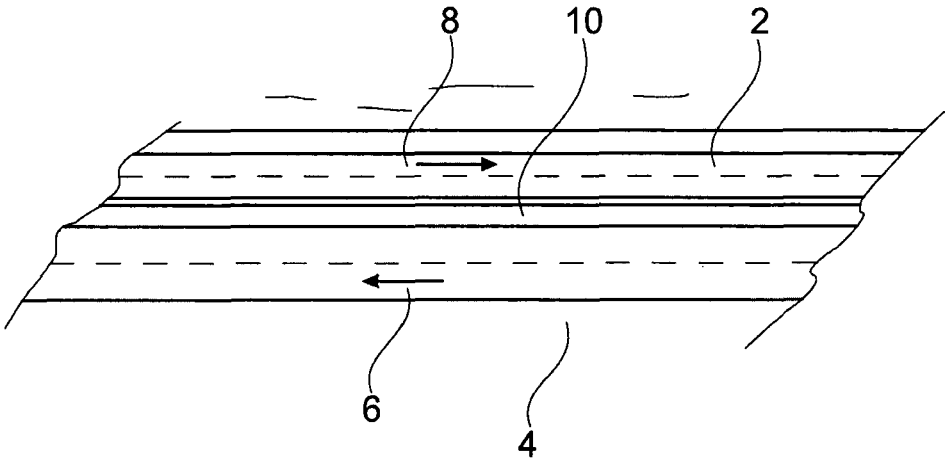

| | | | | |
|---|---|---|---|---|
| 2012/0107049 | A1* | 5/2012 | Kim | E21D 9/005 405/150.1 |
| 2014/0090191 | A1* | 4/2014 | Aston | E02D 29/045 14/77.1 |
| 2015/0322635 | A1* | 11/2015 | Aston | E01D 19/04 52/742.14 |
| 2016/0090831 | A1* | 3/2016 | Malcolm | E21B 7/20 175/27 |

* cited by examiner

METHOD AND APPARATUS FOR FORMING TUNNELS FOR TRANSPORT ROUTES

CROSS-REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable

STATEMENT REGARDING PRIOR DISCLOSURES BY THE INVENTOR OR A JOINT INVENTOR

Not applicable

BACKGROUND OF THE INVENTION

(1) Field of the Invention

The invention to which this application relates is to a method and apparatus which can be used in the formation of tunnels and in particular, tunnels which can be used as a means for passenger transport therealong in addition, or alternatively, to existing transport means.

(2) Description of Related Art Including Information Disclosed Under 37 CFR 1.97 and 1.98

In certain cases, the existing transport means may be kept in operation whilst the new route is created and when the new route is functional the existing transport means is closed. Alternatively a new route is created in accordance with the invention to be used in addition to the existing transport route, or the new route may in fact be a completely new facility and created independently of and without any reference to any existing transport routes.

Increasingly, there is a demand to look more closely at the transport routes which are used for train tracks and roads and the need to have these transport routes above, or on, the surface. This demand is particularly relevant in conurbations where, firstly, the provision of the transport route on or above the surface, causes disruption in terms of noise and pollution to residents who happen to be living close by and, secondly, the transport routes take up valuable land which could be more profitably used for other purposes.

It is known to be able to provide tunnels to allow at least a part of the transport route to be located underground and thereby make the space on the surface available for other uses. However, the use of conventional tunneling techniques in which the tunnels are bored through the rock and soil to form the new, tunneled, transport route, is expensive and is required to be formed at the depth of, typically, 20 to 30 meters under the surface. The need to provide the tunnels at that depth under the surface, does, in turn, mean that the access routes to and from the tunnel from the surface, need to pass at a pre-determined steepness of slope. However, due to the depth of the known tunneling techniques, this means that the access routes themselves need to be relatively long which, in turn, means that a significant amount of space is required to be provided at each end of the tunneled portion. This adds significant further expense to the project and also, in certain instances, means the project cannot practically achieved due to the required space at each end for the access routes.

It is also known to provide underpasses which typically comprise a relatively short section of tunnel which allow a transport route to pass through the underpass and normally transversely to the transport route which is located on the surface. The purpose of these underpasses is to allow different transport routes at different levels to cross while minimising the disruption to the existing transport route while the underpass is formed thereby allowing grade separation.

BRIEF SUMMARY OF THE INVENTION

It is therefore an aim of the present invention to provide a means of forming a tunnel to allow a transport route to pass therealong whilst, at the same time, minimising any disruption to any existing transport routes, minimising environmental and social surface disruption, and also minimising the amount of space which is required to be used when forming the tunnel and to allow subsequent access to and from the same. At the same time it is imperative that the tunnel which is formed has the structural strength to have the required relatively long lifespan, once formed.

In a first aspect of the invention there is provided a method of forming a tunnel structure, said method comprising the steps of forming at least two spaced apart access tunnels along a length, forming at least one guide surface along each of the access tunnels, introducing a plurality of units from at least one end of the said length and successively sliding the said units along the said at least one guide surface of said access tunnels, said units successively introduced and moved along a linear path as the material in which the tunnel is to be formed is excavated in advance of the leading one of the said units with respect to the direction of movement of the units, until the required length of tunnel is formed and wherein the path along which the tunnel is formed is located under or adjacent to an existing transport route.

Typically, the existing transport route can continue to be used during at least the majority of time of forming the said tunnel.

In one embodiment, the existing transport route can be retained in use following the formation of said tunnel or, once the tunnel is formed, the transport route can be decommissioned such that the transport route passes along the tunnel which has been formed and the surface above the tunnel can be used for other purposes.

In one embodiment, the tunnel is formed underneath the said existing transport route or to a side of the existing transport route.

In one embodiment of the invention, the units are formed to provide at least the roof section and the said access tunnels are positioned to form at least part of the side walls of the tunnels.

In one embodiment, prior to moving the units along the surfaces of the access tunnels are plurality of piles are formed downwardly from the access tunnels and along the said access tunnels. Typically therefore the main tunnel is formed by the said units, access tunnels and piles.

In one embodiment, the main tunnel is formed with at least one intermediate wall or walls which are substantially parallel to the side walls and which can be used as a barrier between, for example, respective lanes and/or tracks formed along the tunnel. Alternatively first and second tunnels can be formed to run parallel.

The provision of the tunnel in this form means that the tunnel can be formed at a substantially reduced depth from the surface such as, for example, between 2 and 10 meters from surface. As a result of this, the depth in which the access roads are required to pass from the surface to the entrance to the tunnel is substantially reduced and so the overall length of the construction which is required in order to form the tunnel and access roads is considerably reduced with respect to the prior art method and system and which in turn means that there is a practical possibility of providing the tunnel structure whereas previously, using conventional construction techniques, space and/or size constraints means that the same is not possible.

Typically, a shielded or enclosed area is provided in advance of the leading unit and within which excavation works occur in order to form the space in the soil into which the units can be moved.

Typically, the units are moved into position successively, by jacking apparatus which is provided at the end from which the tunnel is formed and which progressively move the units into position.

Typically, the access tunnel surfaces along which the units are slid are provided as tracks along which the units can be slid. The access tunnels are initially formed in and the tracks are then prepared in the same for the receipt of the units therealong.

In one embodiment, the units are pre-cast and delivered to the site of use for introduction to form the tunnel or, alternatively, the said units are formed on site.

In either embodiment, the units are typically formed from concrete which is suitable re-enforced to form the structural requirements of the tunnel.

In a further aspect of the invention, there is provided a tunnel including a plurality of units, at least two spaced access tunnels including a track along which successive units are slide into position and supported thereby, wherein said units and access tunnels, in combination, form at least part of the side walls and roof of the tunnel and a plurality of piles depend downwardly from, and are spaced along, the access tunnels and said tunnel is formed in parallel with an existing transport route so as to provide a transport route therealong in addition, or alternatively, to the existing transport route.

Typically a portion or portions of the existing transport route at least at one end of the tunnel are used as a means for approach to access the said end of the tunnel.

Thus, in accordance with the invention, there is provided a method and apparatus for the formation of a tunnel structure at a relatively shallow depth from the surface and to allow the tunnel which is formed, to be used as a replacement or additional transport route to an existing transport route which is formed on the surface. The ability to form the tunnel in parallel with the existing transport route means, for example, that the existing transport route can be used as a means for approach to access the ends of the tunnel once the same is formed, with minimum disruption.

BRIEF DESCRIPTION OF THE SEVERAL VIEWS OF THE DRAWING(S)

Figure 1B:
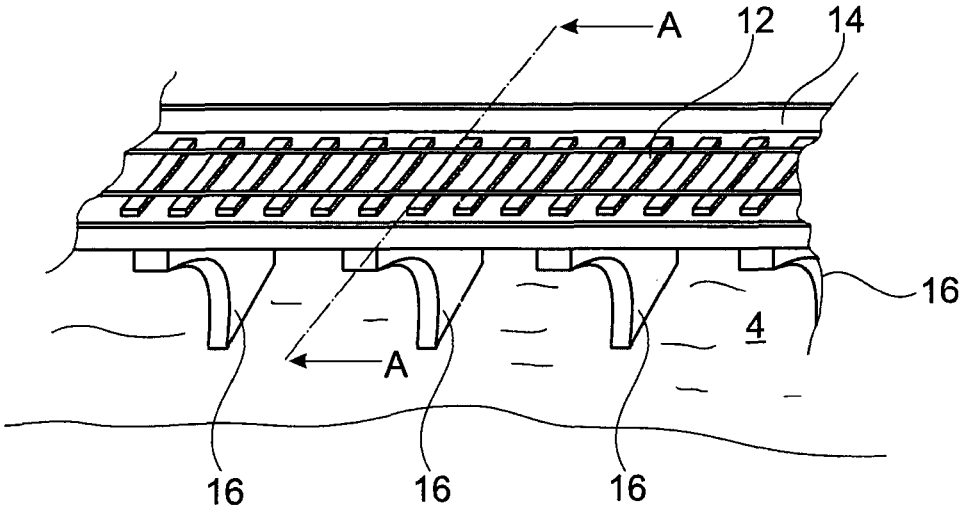
Figure 2:
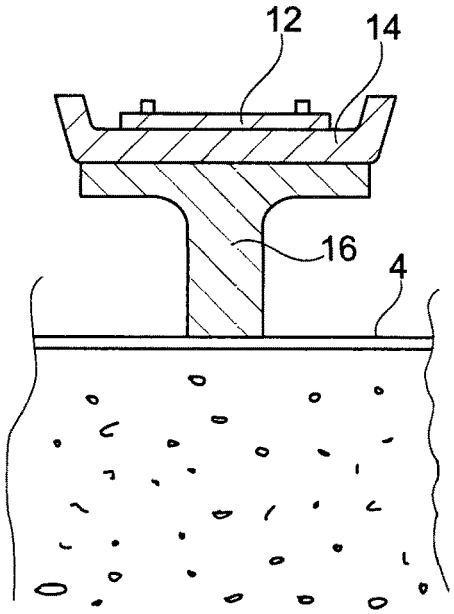
Figure 3C:
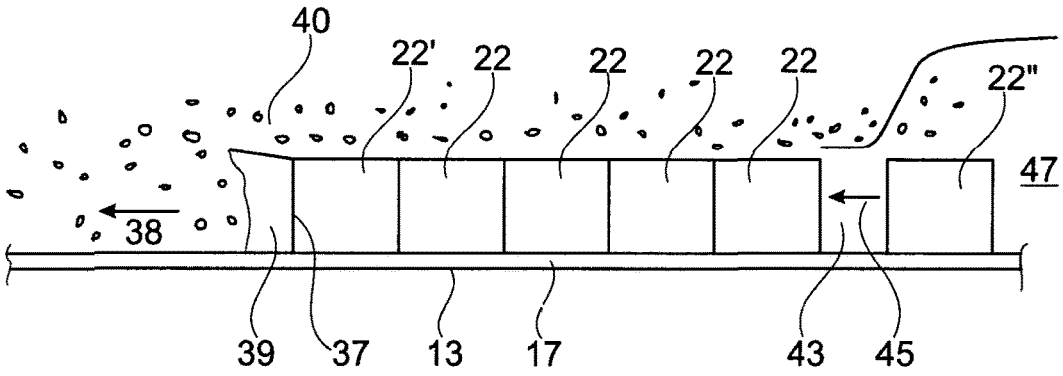
Figure 3A:
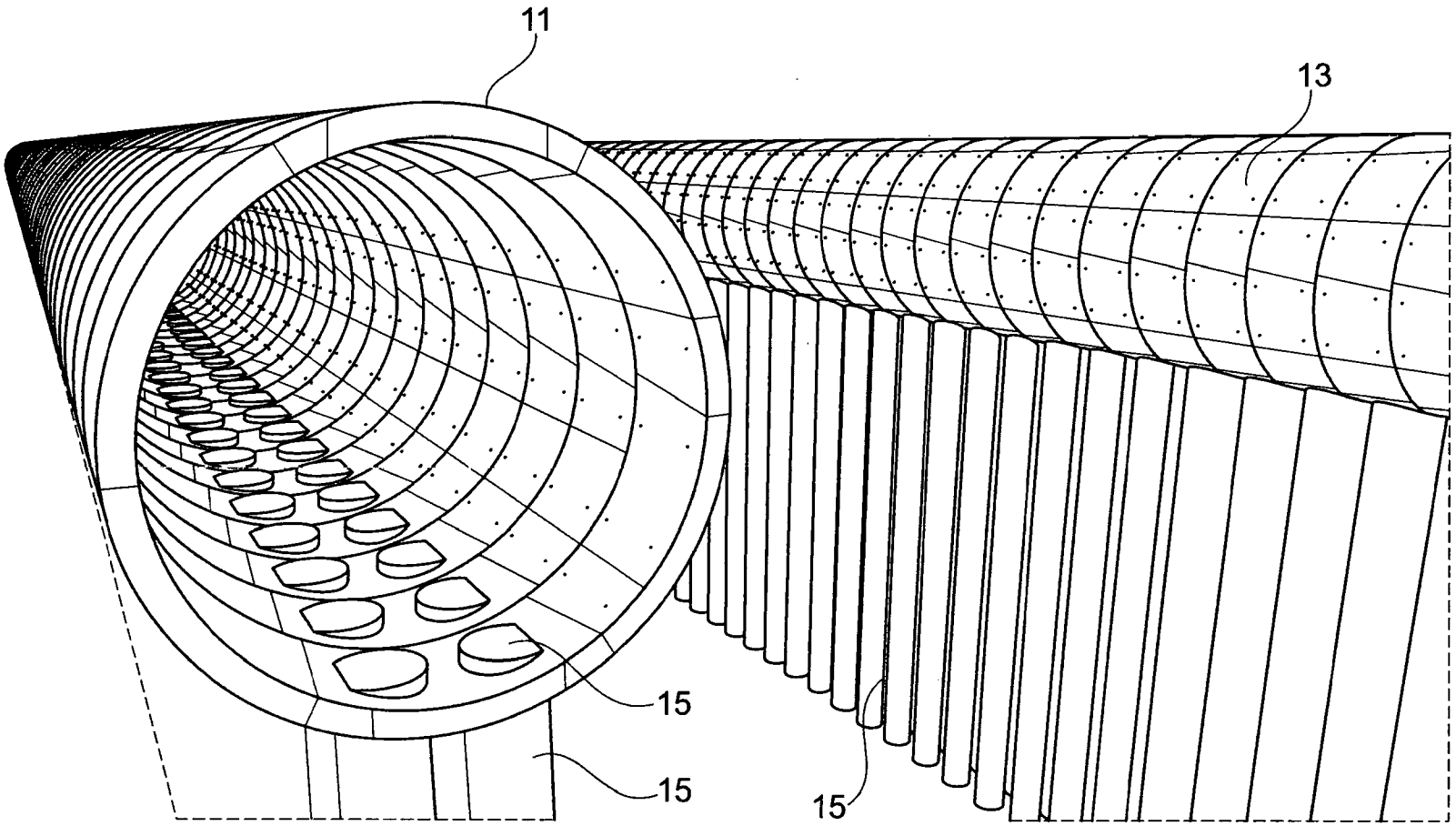
Figure 3B:
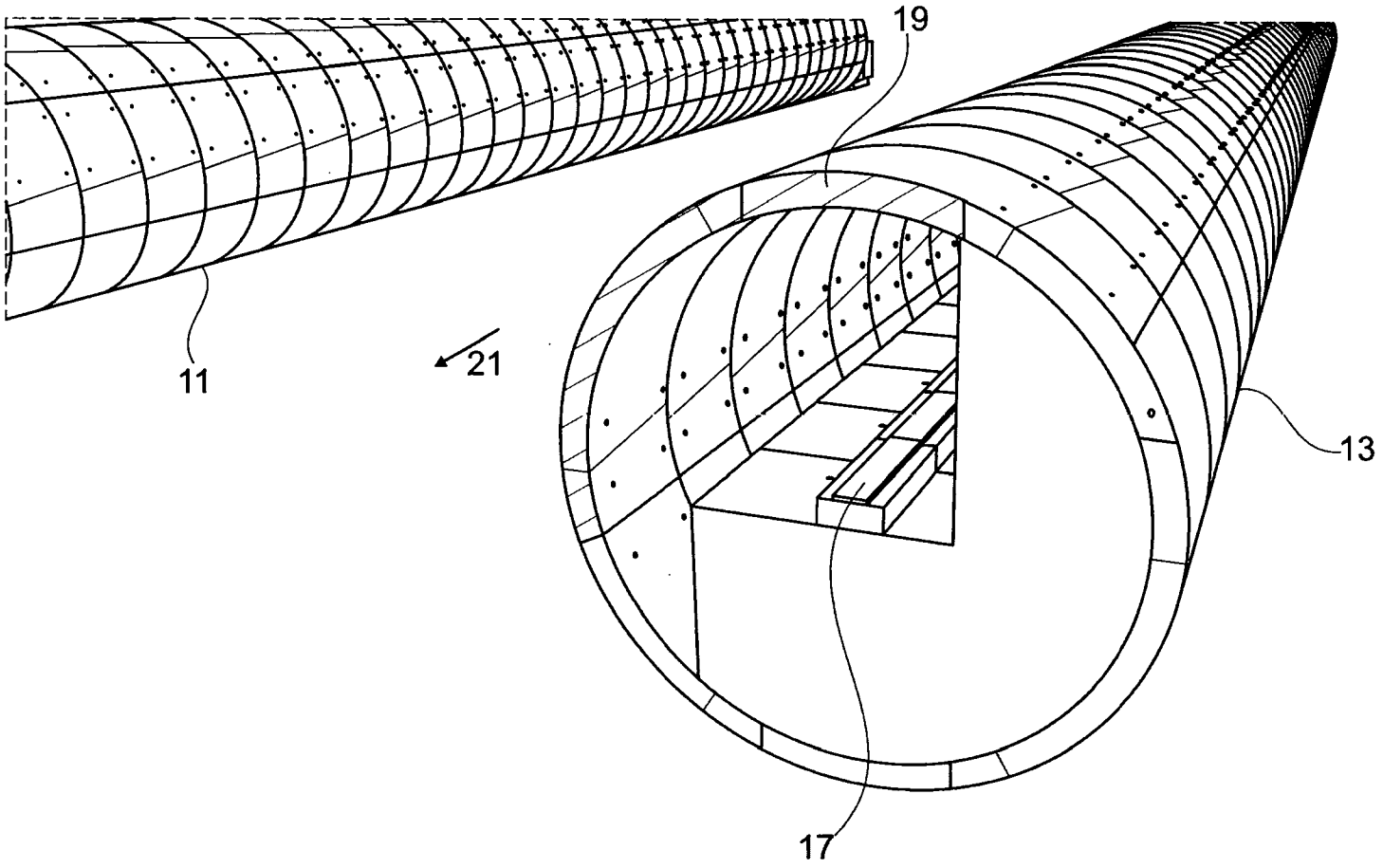

Specific embodiments of the invention are now defined with respect to the accompanying drawings wherein;

FIGS. 1*a* and *b* illustrate two examples of existing transport routes;

FIG. 2 illustrates a cross-section along line A-A of the transport route of FIG. 1*b*, the surface and soil underneath through which the tunnel in accordance with the invention is formed;

FIGS. 3*a-c* illustrate the formation of the access tunnel and use of the same in accordance with the invention; and FIGS. 4*a-e* illustrate embodiments of tunnels formed in accordance with the invention.

DETAILED DESCRIPTION OF THE INVENTION

Referring firstly to FIGS. 1*a* and *b* there are illustrated two forms of conventional transport routes with which the current invention is particularly effective. In FIG. 1*a* there is shown a transport route in the form of a dual carriageway road 2 on a surface 4 and which has two lanes which allow traffic to travel in direction 6 and two lanes which allow traffic to travel in direction 8. A central reservation barrier 10 is provided between the two sets of lanes for safety purposes.

FIG. 1*b* illustrates a second form of transport route 2 which could again be road transport but in this case is a rail track 12 which is supported on a base 14 which in turn is raised from the surface by a series of spaced support formations 16 and which effectively renders the surface 4 under and adjacent to the support structure unusable. Although one track 12 is shown, a number of tracks may be provided in parallel. In both examples it will be appreciated that a considerable amount of surface area 4 is taken up and used by the transport route itself as is the case in FIG. 1*a* or by the support structure for the transport route as is the case in FIG. 1*b*.

The present invention allows the transport routes to continue to be provided, or indeed have an increased capacity, whilst making the previously required surface area available for other uses and does so whilst having no, or relatively minimal, impact on the continued use of the existing transport route whilst the new transport route is formed.

The initial steps by which the transport route can be formed in accordance with the invention are illustrated in FIGS. 3*a-b*. The first steps are for the access tunnels 11, 13 to be formed along the new tunnel route and at a spaced apart distance under the surface 4. The route is typically under the existing transport route and/or substantially parallel to the existing transport route. These access tunnels can be formed using boring techniques as they are relatively small in diameter. Once the access tunnels are formed, piles 15 are formed progressively along the access tunnels and downwardly thereform, as illustrated in FIG. 3*a*, to provide the support for the access tunnels, and structure in general.

Once the access tunnels have been formed and before or after the piles have been completed, the access tunnels are prepared for the movement of units therealong and this preparation includes the formation of guide surfaces such as slide tracks 17 along the length thereof. The next stage is for part of the access tunnels to be removed, as illustrated by the hatched portion 19 illustrated in FIG. 3*b*, in order to expose the tracks and allow the tunnel units 22 to be successively moved along the tracks 17 from one end and is indicated by the arrow 21.

The structure 20 is formed from a series of units 22 which are successively moved along the slide tracks 17 formed in each exposed access tunnel 11, 13. In this embodiment the units each comprise side wall portions 26, 28, and a roof section 30 which, in conjunction with remaining portion of the access tunnel and pilings 15 define the tunnel cavity 34 along which the new transport route 36, such as the new road will pass.

In order to be able to advance the units 22, then, as shown in FIG. 3*c*, at the leading edge 37 of the line of units in the direction of movement 38 there is provided a shielded portion 39 within which the soil and/or other material 41 can be excavated in order to make a sufficient space to accommodate the leading unit 22 and subsequent units 22. New units 22 are added in the direction indicated by arrow 45 to the line of units from the other end 43 of the line of units at jacking area 47 at the opening into the tunnel and this process continues with successive until the tunnel of required length has been formed.

As the tunnel structure is formed in the manner described, the tunnel has its own integral strength and therefore can be formed and positioned at a significantly shallower distance from the surface 4 than when using conventional tunnel boring techniques. This in turn means that the distance 18 which has to be dealt with by access roads down to and up from tunnel to the surface 4 can be significantly shorter in length and thereby reduce the amount of land which is required to be provided in order to form the tunnel structure.

In FIG. 2 there is illustrated a sectional end elevation of the conventional transport route shown in FIG. 1*b*.

Figure 4A:
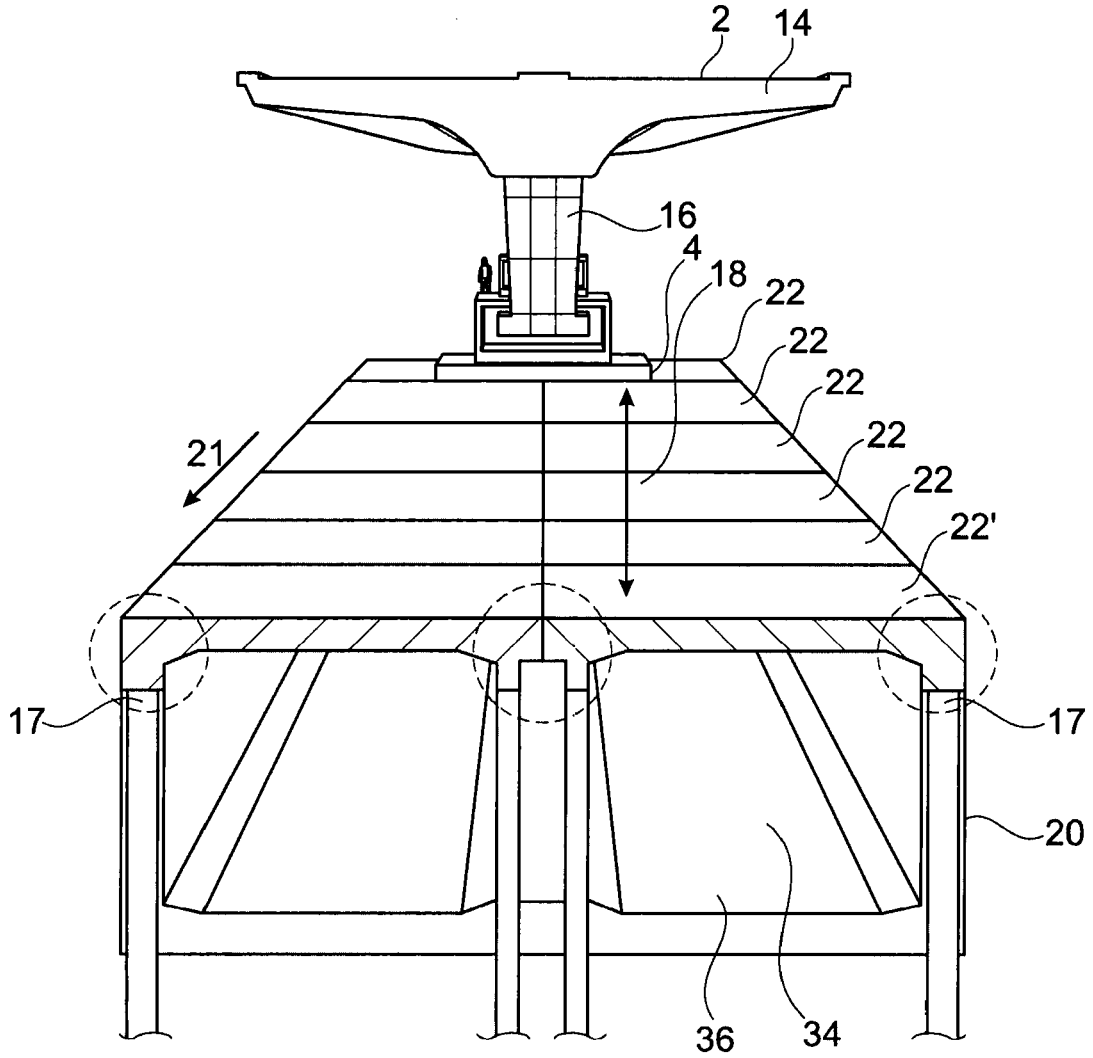
Figure 4B:
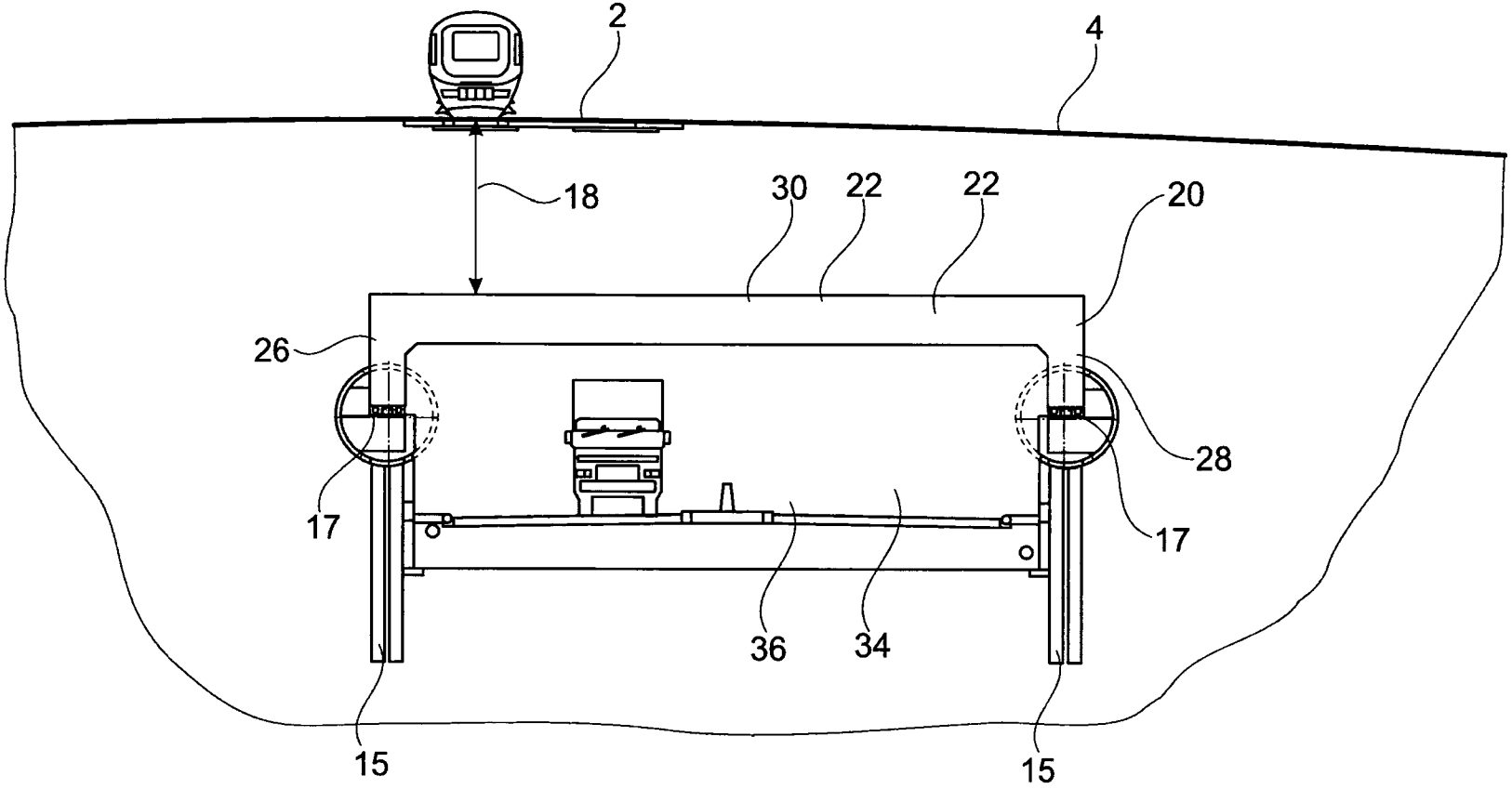
Figure 4C:
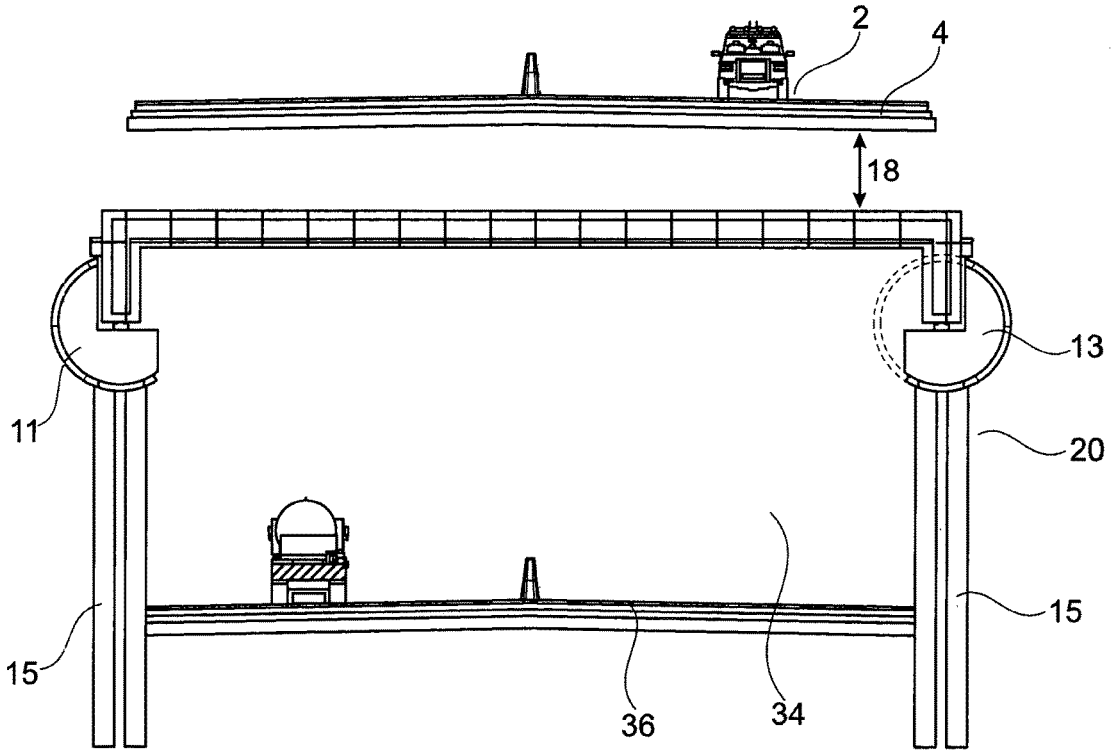
Figure 4D:
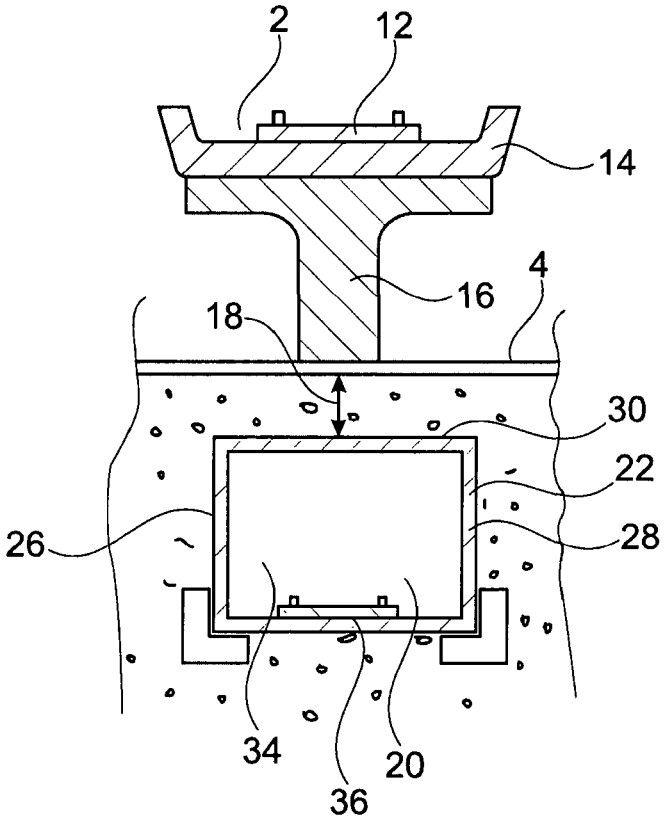
Figure 4E:
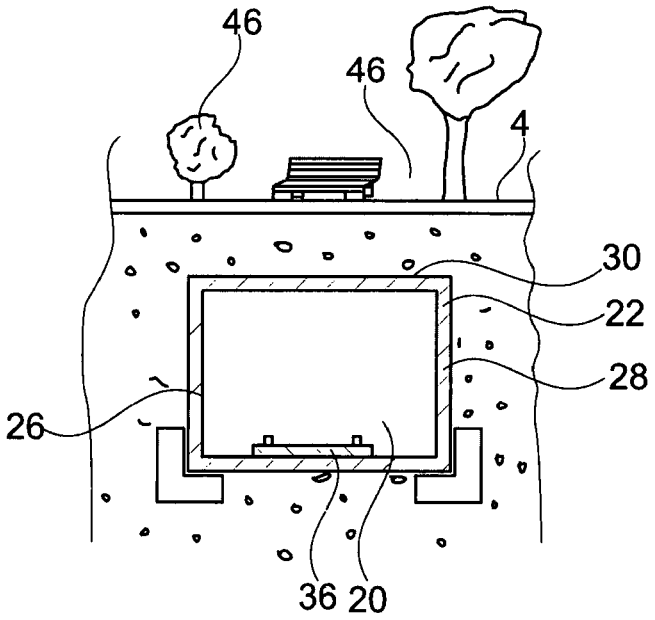

The tunnels are formed under existing transport routes 2 and FIGS. 4*a-d*, illustrate examples of that where it is shown that under the transport route 2, there is formed a tunnel structure which runs parallel with the existing transport route at a spaced distance 18 under the surface 4. FIGS. 4*a* and *d* illustrate the formation of the tunnel structure 20 under and parallel with the existing transport route 2. They also show how the existing transport route 2 can still be used at this stage and may continue to be used afterwards if the purpose of the new tunnel structure 20 has been to increase transport capacity. Alternatively, if the aim is to provide a replacement transport route, the tunnel structure 20, with its new transport route 36, can now act as the only transport route as illustrated in FIG. 4*e* and existing surface mounted structures such as the structure 14, 16 can be removed from the surface 4. Equally, the existing transport route can be decommissioned along the length of the tunnel and the surface 4 put to new, and more environmentally and/or economically useful purposes, such as parkland 46. The newly available surface land can be used for other purposes such as building, parks or the like which, when the land may be in a relatively built up area in a city is of major benefit.

In certain cases the tunnel formed in accordance with the invention can be used in conjunction with open cut sections so that along the length of at least a portion of the road there are provided tunneled sections and open cut sections, with new road being under the surface and not visible from the surface.

What is claimed is:

1. A method of forming a tunnel structure which once formed includes a new transport route for use instead of, or in addition to, an existing transport route, said method comprising the steps of forming at least two parallel spaced apart access tunnels along a length which the tunnel structure is to be formed, forming at least one guide surface along each of the access tunnels, introducing a plurality of units from at least one end of the said length and successively sliding the said units along the said at least one guide surface of said access tunnels, said units successively introduced and moved along a linear path as the material in which the tunnel structure is to be formed is excavated in advance of the leading one of the said units with respect to the direction of movement of the units, until the required length of tunnel structure is formed and the path along which the tunnel structure is formed is located under said existing transport route and the said path is substantially parallel with the said existing transport route with a first access ramp formed at a first end of the said tunnel structure and a second access ramp formed at a second end of the said tunnel structure to link the respective ends of the said new transport route formed in the said tunnel structure to the existing transport route and allow the passage of trains or vehicles from the existing transport route along the said new transport route through the tunnel structure once formed and said tunnel structure lies at a depth under the said surface on which the existing transport route is formed in the range of 2-10 meters.

2. A method according to claim 1 wherein the existing transport route continues to be usable during the forming of the said tunnel structure.

3. A method according to claim 1 wherein the said units are formed to provide at least the roof section of the tunnel structure and the access tunnels are positioned to form at least part of the side walls of the tunnel structure.

4. A method according to claim 1 wherein a plurality of piles are formed downwardly from the access tunnels and spaced along the said access tunnels.

5. A method according to claim 4 wherein the tunnel structure is formed by the said units, access tunnels and piles, in combination.

6. A method according to claim 1 wherein the tunnel structure is formed with at least one intermediate wall which is substantially parallel to the side walls.

7. A method according to claim 6 wherein the intermediate wall acts as a barrier and splits the tunnel structure into two transport portions.

8. A method according to claim 1 wherein first and second tunnel structures are formed side by side.

9. A method according to claim 1 wherein at at least one end of the tunnel structure, a portion of the existing transport route is used as a means of gaining access to the end of the tunnel structure.

10. A method according to claim 1 wherein a shielded or enclosed area is provided in advance of the leading unit and within which excavation works occur in order to form space into which the units can be advanced.

11. A method according to claim 1 wherein the units are moved into position successively by jacking apparatus which is provided at the end from which the tunnel structure is formed and which progressively moves the successive units into position.

12. A method according to claim 1 wherein the said access tunnels are initially formed along the path of the tunnel structure and tracks are then prepared in and along the access tunnels for the receipt of the units therealong.

13. A method according to claim 1 wherein the units are formed from concrete which is re-enforced to form the structural requirements of the tunnel structure.

14. A tunnel structure including a plurality of units, at least two spaced access tunnels including a track along which successive units are slid into position and supported thereby, wherein said units and access tunnels, in combination, form at least part of the side walls and roof of the tunnel structure and a plurality of piles depend downwardly from, and are spaced along, the access tunnels and said tunnel structure is formed under and in parallel with an existing transport route so as to provide, once the said tunnel structure is formed, a new transport route therealong for use in addition, or alternatively, to the said existing transport route, wherein a portion or portions of the existing transport route at one end of the tunnel structure are used as a means for approach to access a first end of the said new transport route in the tunnel structure via a first access ramp formed at a first end of the said tunnel structure and a second access ramp located at a second end of the said tunnel structure is provided to allow an opposing end of the new transport route in the tunnel structure to be linked to the existing transport route and allow the passage of trains or vehicles from the existing transport route along the new transport route through the tunnel structure and wherein said tunnel structure lies at a depth under the said surface on which the existing transport route is formed, in the range of 2-10 meters.

* * * * *